US009517550B2

(12) United States Patent
Palmisano

(10) Patent No.: US 9,517,550 B2
(45) Date of Patent: Dec. 13, 2016

(54) DUAL-HEAD TOOL SYSTEM WITH SAFETY LOCK

(71) Applicant: Douglas Palmisano, Pompano Beach, FL (US)

(72) Inventor: Douglas Palmisano, Pompano Beach, FL (US)

( * ) Notice: Subject to any disclaimer, the term of this patent is extended or adjusted under 35 U.S.C. 154(b) by 354 days.

(21) Appl. No.: 13/968,636

(22) Filed: Aug. 16, 2013

(65) Prior Publication Data

US 2014/0144299 A1 May 29, 2014

Related U.S. Application Data

(60) Provisional application No. 61/684,722, filed on Aug. 18, 2012.

(51) Int. Cl.

| | |
|---|---|
| ***B25B 23/00*** | (2006.01) |
| ***B25B 15/02*** | (2006.01) |
| ***B25G 1/08*** | (2006.01) |

(52) U.S. Cl.

CPC ..... *B25B 23/0042* (2013.01); *B25B 15/02* (2013.01); *B25B 23/0035* (2013.01); *B25G 1/085* (2013.01)

(58) Field of Classification Search

CPC .. B25B 23/0042; B25B 23/0035; B25B 15/02; B25G 1/085

See application file for complete search history.

(56) References Cited

U.S. PATENT DOCUMENTS

| | | | | |
|---|---|---|---|---|
| 2,674,286 | A * | 4/1954 | Carson | 81/177.4 |
| 5,964,132 | A * | 10/1999 | Chen | 81/439 |
| 6,029,549 | A * | 2/2000 | Baker | 81/439 |
| 6,260,452 | B1 * | 7/2001 | Yu | 81/177.2 |
| 6,585,444 | B1 * | 7/2003 | Podbutzky | 403/322.1 |
| 2011/0083536 | A1 * | 4/2011 | Palmisano | 81/439 |
| 2013/0269117 | A1 * | 10/2013 | Wilkinson | 7/167 |

* cited by examiner

*Primary Examiner* — David B Thomas

(74) *Attorney, Agent, or Firm* — Bennett Intellectual Property; Allen F. Bennett

(57) ABSTRACT

A dual-head tool has a handle with a longitudinal bore extending longitudinally its entire length. A shaft is housed within the bore and may be slid longitudinally to expose either of its two tool heads, but not both simultaneously. A lock arm is pushed down so that it is flush with the shaft and handle and a cam on the lock arm engages a recess in the shaft so that the shaft is firmly held extending out of one side of the handle to allow use of one of the tool heads. The head of the lock arm covers the open end of the bore not in use. A piston biased by a spring engages a keyway in the shaft to prevent the shaft from being removed from the bore.

19 Claims, 2 Drawing Sheets

DUAL-HEAD TOOL SYSTEM WITH SAFETY LOCK

FIELD

The present invention relates to systems and apparatus's providing two tools in one. More particularly, the invention relates to devices that have two tool heads and safety features that protect the user from failure and accidental injury.

BACKGROUND

Screwdrivers used for tightening and loosening threaded screw fasteners are well known and usually consist of a shaft or shank having a handle at one end and a driving tip at the other end for engaging a head of the screw to be driven. Usually the shank and tip are integrally formed from a single piece of steel or other strong metal. The handle is usually formed of plastic, wood or other suitable material and is permanently joined to the shaft. While these screwdrivers work well, certain jobs may require different sized or shaped tips. Several screwdrivers therefore may be needed at a particular job site for driving different type screws encountered. One also may not be certain what particular type of screwdriver is needed for a certain job, but wants to be prepared for the different screws that they may confronted with. This requires that one have on hand a set of multiple, different screwdrivers that can be used for a variety of different jobs. Because each screwdriver has its own handle and shaft, this can be cumbersome, take up a relatively large amount of space, and add to the weight of the screwdrivers that must be carried.

There are screwdrivers that utilize a single handle and shank, but that have a variety of different tips that can be interchanged on the shank. The shaft is usually provided with some type of socket, with the tip being formed as a separate bit or similar device that can be inserted and removed from the socket. Because several different bits are provided with the screwdriver, and they are usually fairly small in size, it is not uncommon that the bits become lost or misplaced. For this reason, the handles on some screwdrivers are hollowed out at the end to provide a storage compartment where the extra bits can be stored. An end cap is usually provided to close off the storage compartment. Because the extra bits are usually held loosely within this compartment, they often tend to rattle around, creating a nuisance to the user. When it is desired to select a bit from the hollowed-out storage area, it is often difficult to see the bits so that the bits must be poured out or otherwise removed from the storage area so that the appropriate bit can be selected. This increases the likelihood that the bits will be dropped and eventually lost.

In some cases, the screwdrivers may be provided with a removable shaft. A different tip can be provided at each end of the removable shank. By removing and inverting the shank, the screwdriver can be provided with at least two different tips. While removable shanks are known, there has not been a screwdriver that has an adjustable length shank that can be effectively secured to the handle.

Other designs provide for a shaft having a tool head at each opposite end. The shaft may be removed, turned around, and reinserted into the handle. Alternatively, the shaft may be slid our of opposite ends of the handle to access and use different heads. However, the mechanics of such dual use tools are often overly complex, increasing the likelihood of failure. In addition, they lack any safety features to protect a user in the case of such a failure of the locking mechanism.

None of the tools of the prior art address these design flaws. It is therefore desirable to provide a dual use tool that has a minimum of moving parts, is durable, reliable and incorporates safety features to prevent and/or mitigate failure of the locking device or other integral mechanisms.

SUMMARY

Accordingly, the primary object of the present invention is to provide a dual head tool having a minimum of moving parts, durable construction and safety features.

In one embodiment, a dual-head tool comprises a handle having a longitudinal bore having a non-circular cross-section. The tool also includes a shaft having two tool heads at each end, a cross-section congruent to the cross-section of the bore, two recesses and a longitudinal keyway defined by two shoulders. In addition, the tool has a lock arm having a double cam base attached to the handle by a pivot pin, an elongate body and a head and a piston housed in a recess in the handle and biased by a spring such that it impinges upon and engages the keyway of the shaft.

The lock arm may be configured perpendicular to the handle and the shaft to facilitate longitudinal movement of the shaft within the bore. In this configuration, the lock arm may be pivoted so that it is parallel and flush to the shaft and handle. As a result, one of the cams of the lock arm frictionally engages one of the recesses of the shaft such that the head of the lock arm covers the end of the bore from which the shaft is not currently extended.

It is therefore an object of the present invention to provide a dual-head tool that has added safety features to mitigate failure of the internal components, is reliable and easy to manufacture.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

DETAILED DESCRIPTION

Figure 1:
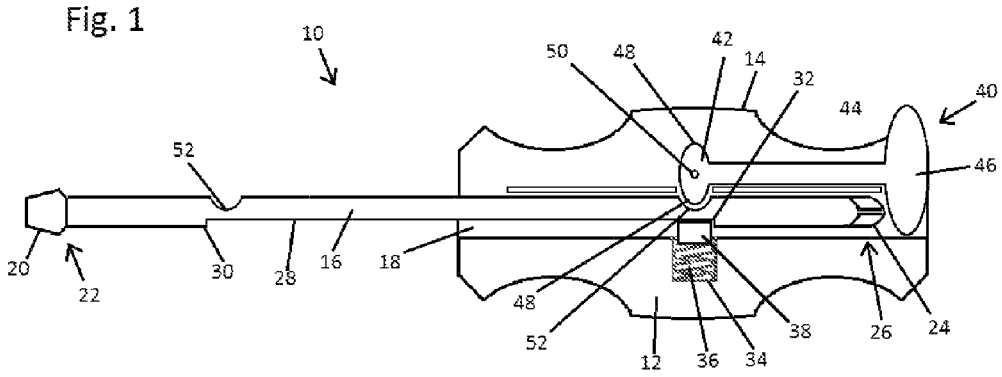
FIG. 1 is a side cross-sectional view of a dual-head tool in accordance with the principles of the present invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

FIG. 1 shows a cross-sectional view of a dual-head tool 10 in accordance with the principles of the invention. The screwdriver may include a handle 12 that may be comprised of wood, plastic, resin or other sufficiently rigid material and may be electrically insulating. Optionally, the handle 12 may have an outer surface 14 that may enhance secure gripping, for example an elastomeric coating having a high coefficient of static friction with human hands or gloves. Optionally the outer surface may be fluted, corrugated or knurled. The handle 12 may be ergonomically shaped so that it may be grasped and rotated in either direction easily, and thus may have longitudinal bi-symmetry as well as radial symmetry. The handle 12 may also include a bore 18 that extends longitudinally through the center of the handle 12 for its entire length.

A shaft 16 traverses the length of the bore 18 and may be made of a solid material such as a metal alloy and may preferably be capable of transferring both directional and torsional force. The shaft may have a cross-section that is square, octagonal, hexagonal or the like, which correspond to the cross-section of the bore 18 and may allow for transference of torsional force between the shaft 16 and the handle 12.

The shaft 16 may have a tool head at each of its two ends. In this embodiment, the tool includes a flat-head 20 at a first end 22 and a phillips head 24 at a second end 26 each located at opposite ends of the shaft 16. The shaft may also include a keyway 28 that ends at shoulders 30 and 32 which define the keyway 28. The keyway 28 may have equal width with the shaft 16 and thus occupy an entire side of the shaft or optionally may be a groove or channel along one surface.

The handle may include a cavity 34 housing a spring 36 and a piston 38. The spring 36 may bias the piston 38 toward the bore 18 and may thus result in the piston 38 impinging upon the shaft 16. Piston 38 may be configured to fit within a keyway 28. Because keyway 28 may be finite and defined by shoulders 30 and 32, the piston 38 and keyway 28 may interact so as to prevent the shaft 16 from ever being removed from the handle 12 completely. This feature may prevent the shaft from leaving the handle 12 after it has been inserted.

The cavity 34 may or may not be accessible from the outside and may be formed integrally during manufacture of the handle by molding or other means. The spring 36 and piston 38 are inserted into the cavity 34. The shaft may be inserted into the bore by the flat head end and pushed passed and over the piston 38. Once the piston 38 engages the keyway 28, the shaft may become permanently locked within the bore such that upon failure of locking or other mechanisms the shaft will not exit the handle 12.

Also shown in FIG. 1 is lock arm 40 having a base 42, a body 44 and a head 46. The base 42 may have a dual-cam configuration, having two cams 48 on either side. Pivot pin 50 may secure lock arm 40 within the handle 12 and allow pivotal movement about it such that the lock arm may swing.

FIG. 1 shows the cam 48 at the base 42 of the lock arm 40 engaged with a recess 52 on the shaft 16. By engaging the recess 52, the lock arm 40 may hold the shaft 16 and itself firmly in place at least in part due to static friction between the cam 48 and the recess 52. The head 46 of the lock arm 40 also may extend into the bore such that the second end 26 is covered and blocked while the first end 22 extends outward from the handle 12 and may be utilized. In some instances, if excessive force were applied to the end of the shaft being used, it is possible that a locking mechanism may fail and result in the shaft propelling rapidly through the wrong end of the handle, resulting in injury. By blocking the end of the bore, the head 46 of the lock arm 40 may enhance safety by preventing injury in the case of lock or other failure within the system.

Figure 2:
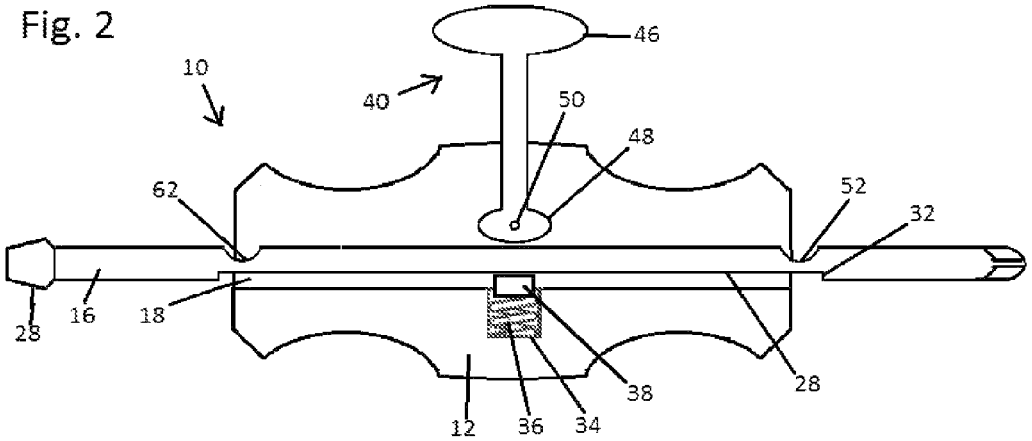
FIG. 2 is a side cross-sectional view of the dual-head tool of FIG. 1 in a different configuration to allow alternation between the two tool heads.

FIG. 2 shows the dual head screwdriver of FIG. 1 with the lock arm 40 not engaged with the shaft 16 such that the shaft 16 may traverse the bore 18. The movement of shaft 16 through bore 18 is limited by the engagement of the piston 38 with the keyway 28. As mentioned, the shaft 16 and bore 18 may have cross-sections of non-circular and congruent geometry in order to allow transfer of torque when the handle is turned by an operator. Optionally, other mechanisms to facilitate transfer or torsional force may be used, or the transfer of torsional force may take place via the impingement of the cams upon the recesses of the shaft. Cams 48 may not engage the shaft 16 when the lock arm 40 is configured substantially perpendicular to the shaft 16 and the handle 12. The shape of the head 46 of the lock arm 40 also facilitates rapid and easy movement of the lock arm into this position.

To change from using one end of the shaft to the next, for example when desiring to alternate between a flat head and a phillips head end to the shaft, the lock arm 40 may be moved into the position shown in FIG. 2. The shaft may then be pushed through the bore and when the shaft 16 is fully extended the lock arm 40 may pivot about pivot pin 50 such that the body 44 is flush with and parallel to the shaft 16, thereby engaging a recess 52 or 62 and covering the end of the bore housing the end of the shaft not in use. The embodiment shown in FIGS. 1 and 2 uses a combination of elements: the keyway 28, piston 38, the head 46 of the lock arm 40 and the engagement between the recess 52 or 62 with a cam 48. These elements may all increase the safety, reliability and durability of the dual-head screwdriver device and system.

Figure 3:
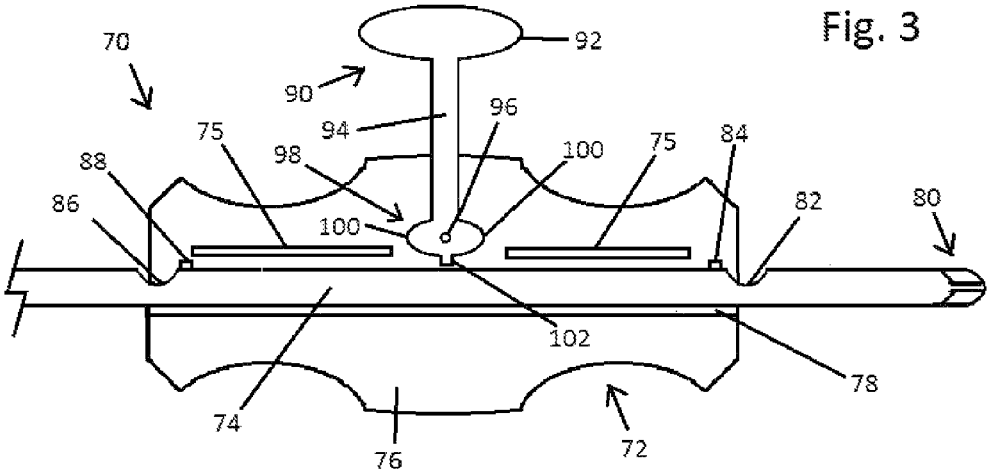
FIG. 3 is a side cross-sectional view of an alternative embodiment of a dual-head tool in accordance with the principles of the present invention.

Referring now to FIG. 3, a dual-head tool 70 built in accordance with the principles of the invention may have a handle 72 substantially similar to the handle 12 of FIGS. 1 and 2, which may include a body 76 and a bore 78 extending longitudinally through the handle 72. A shaft 74 may extend through the bore 78 and include a tool head 80, and a second tool head not shown. The shaft 74 and the bore 78 may have complimentary non-circular cross-sections to maximize the surface area through which torque may be transferred from the handle 76 to the shaft 74.

The shaft 74 may have a recess 82 immediately distal to a crest 84 that may protrude from the shaft 74 and may extend traversely across the width of the shaft in parallel with the rim of recess 82. Similarly, recess 86 may have crest 88 immediately proximal to it.

Locking arm 90 may have a head 92 and body 94 similar to the head 46 and body 44 of locking arm 40 shown in FIGS. 1 and 2. Locking arm 90 may be pivoted about a pivot pin 96. The base 98 may be comprised of two cams 100. In this embodiment, the base 98 of the locking arm 90 may include a tab 102 that may protrude from the bottom of the base and between the tabs 100.

In these embodiments, rotation of the locking arm is accomplished by means of a pivot pin. However, other mechanisms known in the art may be used to translate the locking arm between orientations. Similarly, the embodiments disclosed above utilize a recess and cam mechanism for engaging the shaft with the locking arm. Other mechanisms may be used to facilitate this interaction.

Figure 4:
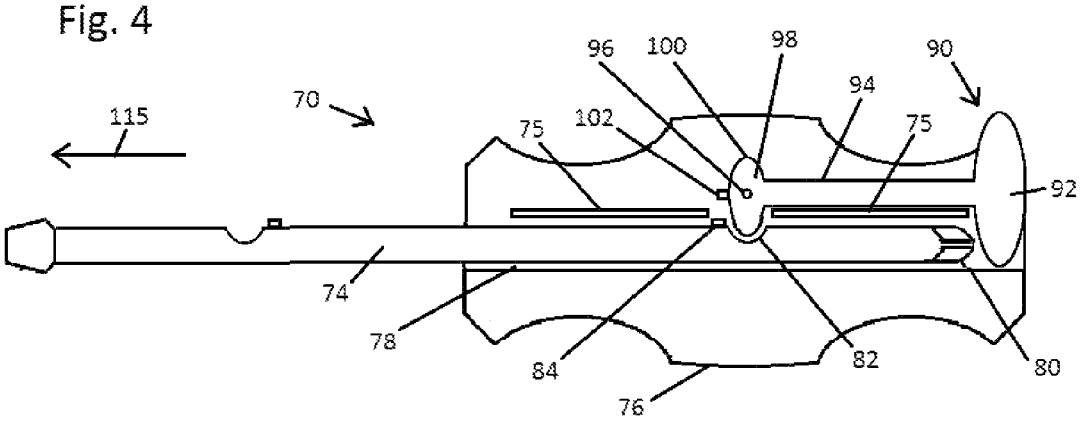
FIG. 4 is a side cross-sectional view of the embodiment of FIG. 3 in a different configuration.

FIG. 4 shows the dual-head tool 70 with the shaft fully extended in the direction of arrow 115. As the shaft moves in the direction of arrow 115, propelled by gravity or other force, crest 84 may impinge upon tab 102, thereby causing locking arm 90 to rotate about pivot pin 96. The locking arm 90 rotates until it is flush with the handle 76 and parallel to the shaft 74. In this position, as shown in FIG. 4, a cam 100 may engage recess 82 such that the shaft 74 may be frictionally engaged securely between the bore 78 and the cam 100. The head 92 of the locking arm 90 may cover the bore and the tool head 80 of the shaft 74. Also shown in FIG. 4 are the walls 75 of bore 78 that may be located on the same side of the shaft 74 as the locking arm 90. It may be desirable to have as much surface area as possible for the bore 78 in order to maximize transfer of torque between the handle 76 and shaft 74.

The embodiment shown in FIGS. 3 and 4 prevents the shaft 74 from fully exiting the bore 78 In this embodiment, shaft 74 may not have a keyway and the handle 72 may not house a spring biased piston. Because the crests 84 and 88 prevent the shaft from moving past either the tab 102 or the cams 100, the shaft may not be removed from the bore, thus increasing safety. This design may decrease the costs of manufacturing.

Figure 5:
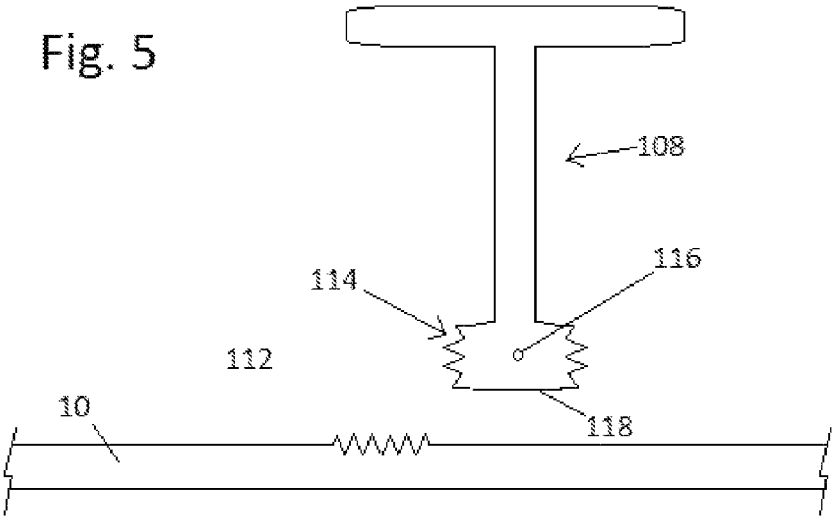
FIG. 5 is a side view of an alternative embodiment of a shaft and a locking arm in accordance with the principles of the invention.
Figure 5A:
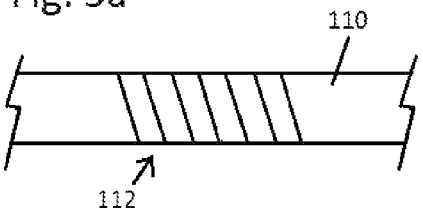
FIG. 5*a* is an enlarged view of the teeth shown in FIG. 5.

FIG. 5 shows a shaft 110 and a locking arm 108 without the handle in order to illustrate another mechanism by which the shaft 110 and locking arm 108 may interact. Locking arm 108 may rotate about pivot pin 116 and, instead of cams, may have rows of teeth 114 that extend transversely across the width of the locking arm 108. The shaft 110 may have a series of corresponding teeth 114 instead of a recess. The teeth 114 and the teeth 112 may interact similarly to a rack and pinion system and, as with some rack and pinion systems, it may be desirable for the teeth not to be aligned at exactly right angles to the shaft 110 and have the teeth 114 on locking arm 108 similarly angled.

While the embodiments as shown in the Figures have a dual-head tool comprising a screwdriver having a flathead and a phillips head for simplicity and by way of example only, other tools heads may be utilized, such as for example, Allen wrenches, star wrenches and the like. It may also be desirable to include a tool head comprising a socket that may engage one or more replaceable tool heads as are commonly found with screwdriver type tools. In such a case, the term dual-head tool may be misleading as a nimiety of tools would be available.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A dual-head tool comprising:

a handle having a longitudinal bore;

a shaft having two ends, each having a tool head, two recesses and a longitudinal keyway defined by two shoulders;

a locking arm having an elongate body, a head, and a base, the base comprising a double cam; and, a piston housed in a recess in the handle and biased by a spring such that it impinges upon and engages the keyway of the shaft;

wherein the locking arm is attached to the handle by a pivot pin;

wherein the locking arm may be pivoted perpendicular to the handle and the shaft to facilitate longitudinal movement of the shaft within the bore and may be pivoted so that it is parallel and flush to the shaft and handle, thereby causing the cams to engage one of the recesses of the shaft such that the head of the locking arm covers the end of the bore from which the shaft is not currently extended.

2. The dual-head tool of claim 1 wherein the shaft may not be removed from the bore once the piston engages the keyway.

3. The dual-head tool of claim 2 wherein the keyway is as wide as the shaft.

4. The dual-head tool of claim 2 wherein the keyway is channel in the shaft.

5. The dual-head tool of claim 2 wherein the tool heads are selected from the group consisting of a flat-head screwdriver, a phillips-head screwdriver, an Allen wrench, a star wrench, and a socket engageable with one or more replaceable tool heads.

6. The dual-head tool of claim 5 wherein the keyway is as wide as the shaft and the tool heads comprise a flat-head screwdriver and a phillips-head screwdriver.

7. The dual-head tool of claim 1 wherein the tool heads are selected from the group consisting of a flat-head screwdriver, a phillips-head screwdriver, an Allen wrench, a star wrench, and a socket engageable with one or more replaceable tool heads.

8. A dual-head tool comprising:

a handle having a longitudinal bore;

a shaft having two ends, a tool heads at each of the two ends, two recesses, and two transverse crests, wherein each of the recesses has one of the crests located proximal to the recess; and, a locking arm having a body, a head, a base, wherein the base comprises a double cam, and a tab protruding from the base between the cams, the locking arm being attached to the handle by a pivot pin;

wherein the lock arm may be pivoted perpendicular to the handle and the shaft to facilitate longitudinal movement of the shaft and may be pivoted so that it is parallel and flush to the shaft and handle, thereby causing the cams to engage one of the recesses of the shaft such that the head of the lock arm covers the end of the bore from which the shaft is not currently extended.

9. The dual-head tool of claim 8 wherein the tool heads are selected from the group consisting of a flat-head screwdriver, a phillips-head screwdriver, an Allen wrench, a star wrench, and a socket engageable with one or more replaceable tool heads.

10. The dual-head tool of claim 9 wherein the tool heads comprise a flat-head screwdriver and a phillips-head screwdriver.

11. A dual-head tool comprising:

a handle having a longitudinal bore having a non-circular cross-section;

a shaft having a tool head at each end, a cross-section congruent to the cross-section of the bore, two rows of teeth and a longitudinal keyway defined by two shoulders;

a locking arm having a two rows of teeth on the sides of its base, an elongate body and a head, wherein the locking arm is attached to the handle by a pivot pin; and, wherein the locking arm may be pivoted perpendicular to the handle and the shaft to facilitate longitudinal movement of the shaft within the bore and may be pivoted so that it is parallel and flush to the shaft and handle, thereby causing the teeth of the locking arm to engage the teeth of the shaft such that the head of the locking arm covers the end of the bore from which the shaft is not currently extended.

12. The dual-head tool of claim 11 wherein the shaft further comprises a piston housed in a recess in the handle and biased by a spring such that it impinges upon and engages a longitudinal keyway in the shaft.

13. The dual-head tool of claim 12 wherein the shaft may not be removed from the bore once the piston engages the keyway.

14. The dual-head tool of claim 13 wherein the keyway is as wide as the shaft.

15. The dual-head tool of claim 13 wherein the keyway is channel in the shaft.

16. The dual-head tool of claim 13 wherein the tool heads are selected from the group consisting of a flat-head screwdriver, a phillips-head screwdriver, an Allen wrench, a star wrench, and a socket engageable with one or more replaceable tool heads.

17. The dual-head tool of claim 16 wherein the tool heads comprise a flat-head screwdriver and a phillips-head screwdriver.

18. The dual-head tool of claim 11 wherein the tool heads are selected from the group consisting of a flat-head screwdriver, a phillips-head screwdriver, an Allen wrench, a star wrench, and a socket engageable with one or more replaceable tool heads.

19. The dual-head tool of claim 18 wherein the tool heads comprise a flat-head screwdriver and a phillips-head screwdriver.

* * * * *